US005111057A

United States Patent [19]

Sugiyama

[11] Patent Number: 5,111,057

[45] Date of Patent: May 5, 1992

[54] STARTER OF AN ENGINE

[75] Inventor: Takeshi Sugiyama, Himeji, Japan

[73] Assignee: Mitsubishi Denki K.K., Tokyo, Japan

[21] Appl. No.: 673,051

[22] Filed: Mar. 21, 1991

[30] Foreign Application Priority Data

Apr. 23, 1990 [JP] Japan ..... 2-107924

[51] Int. Cl.[5] ..... F02N 17/00

[52] U.S. Cl. ..... 290/38 R; 290/48

[58] Field of Search ..... 290/38 R, 48

[56] References Cited

U.S. PATENT DOCUMENTS

| | | | |
|---|---|---|---|
| 3,264,484 | 8/1966 | Keuchen | 290/38/R |
| 3,731,108 | 5/1973 | Kobara et al. | 290/38 R |
| 4,402,286 | 9/1983 | Pagel et al. | 290/38 R |
| 4,803,377 | 2/1989 | Iwatani et al. | 290/38R |

FOREIGN PATENT DOCUMENTS 53-30851 8/1978 Japan .

*Primary Examiner*—A. D. Pellinen
*Assistant Examiner*—Robert L. Hoover
*Attorney, Agent, or Firm*—Sughrue, Mion, Zinn, Macpeak & Seas

[57] ABSTRACT

A starter of an engine which comprises a starting motor, a detector which generates a voltage corresponding with a revolution of the engine, an electromagnetic switch having a coil which draws a plunger that supports a moving contact so that fixed contacts are shorted by the moving contact, and a magnet which retains the drawn plunger, a main switch and a usually open touch switch for activating the electromagnetic switch in starting up of the engine, a voltage comparator which compares a weak inverse direction current flown in the coil when the fixed contacts are closed, with the voltage from the detecting means and outputs a current when the voltage is higher than the weak inverse direction current, and a switch device for stopping the starting motor which makes ON and OFF according an output from the voltage comparator and generates an inverse drawing force by flowing a strong inverse direction current in the coil.

4 Claims, 3 Drawing Sheets

STARTER OF AN ENGINE

BACKGROUND OF THE INVENTION

1. Field of the Invention

The present invention relates to a starter of an engine, and particularly to a starter of an engine having an automatic stopping device for the starter.

2. Discussion of Background

Formerly, a starter of an engine is composed of the starting motor 1, the electromagnetic switch 2, and the key switch 3 of a vehicle as shown in FIG. 3. The electromagnetic switch 2 is composed of two fixed contacts 2*a* and 2*b*, the moving contact 2*c* which opens and closes the fixed contacts 2*a* and 2*b*, the plunger 2*d*, which supports the moving contact 2*c*, and two coils 2*e* and 2*f* which draws the plunger 2*d* whereby the fixed contacts 2*a* and 2*b* are closed by the moving contacts 2*c*, or extinguish a drawing force applied on the plunger 2*d*. In this electromagnetic switch 2, the fixed contact 2*a* is connected to the battery 4 mounted on the vehicle, which is a power source, and the fixed contact 2*b* is connected to the starting motor 1. A terminal of the coil 2*e* is connected to the fixed contact 2*b* and another terminal of the coil 2*e*, to a contact point of the key switch 3, and a terminal of the coil 2*f* is connected to a contact point of the key switch 3 and another terminal of the coil 2*f*, to the earth.

The operation of the this conventional starter of an engine will be briefly explained.

When the key switch 3 is closed for starting up the engine, current flows in both coils 2*e* and 2*f* of the electromagnetic switch 2, by which the plunger 2*d* is drawn since the directions of winding of both coils 2*e* and 2*f* are the same and the magnetic fields produced by both coils are in the same direction, and finally the moving contact 2*c* shorts the fixed contacts 2*a* and 2*b*. When the fixed contacts 2*a* and 2*b* are closed, electric potentials at the both ends of the coil 2*e* are almost the same. Therefore current is not flown in the coil 2*e* and current is flown only in the coil 2*f*, which maintains the plunger 2*d* in a drawn state. In the mean time, when the starting motor 1 is driven and the engine starts up, the key switch 3 is opened. Then, current is flowing (in a reverse direction) from the fixed contact 2*b* to the coil 2*e* and the coil 2*f*. As a result, the magnetic fields produced by the coil 2*e* and the coil 2*f* are cancelled and the drawing force on the plunger 2*e* is lost. The plunger 2*d* is pushed back by a return spring, the moving contact 2*c* returns to the original positions, the fixed contacts 2*a* and 2*b* are opened, and the operation of the starting motor 1 is stopped.

However, in the above mentioned conventional starter of the engine, it is necessary that when the engine is to be started, the key switch 3 is kept closed, the ignition of the engine is judged by a driver according to a starting sound etc., and the key switch 3 is returned to the original positions. This operation is difficult especially for a beginner. Sometimes the engine is difficult to be started up since the driver is not accustomed to the operation of the key switch 3, and sometimes the driver keeps switching the key switch 3 inspite that the engine is already started, which destructs an overrunning clutch of the starting motor 1.

SUMMARY OF THE INVENTION

It is an object of the present invention to provide the starter of an engine capable of starting an engine and stopping the starting motor after the engine is started, with certainty in spite of that a driver is not accustomed to the operations.

According to the present invention, there is provided a starter of an engine which comprises: a starting motor which applies a driving force for starting up an engine; detecting means which generates a voltage corresponding with a revolution of the engine; an electromagnetic switch having a moving contact which opens and closes two fixed contacts being connected to a power source and the starting motor, a coil, one end of which is connected between the starting motor and the fixed contacts, which draws a plunger that supports the moving contact so that the fixed contacts are shorted by the moving contact, and a magnet which retains the drawn plunger; a main switch and a usually open touch switch for starting up of the engine installed in a start-up circuit which connects a power source and the other end of the coil of the electromagnetic switch so that a current is supplied to the coil of the electromagnetic switch for activating the electromagnetic switch in starting up of the engine; a voltage comparator which compares a weak inverse direction current flown in the coil of the electromagnetic switch when the fixed contacts are closed, with the voltage responsive to the revolution number of the engine from the detecting means and outputs a current when the voltage responsive to the revolution number of the engine is higher than the weak inverse direction current; and a switch device for stopping the starting motor which makes ON and OFF according to the existence of an output from the voltage comparator, earthes the other end of the coil of the electromagnetic switch, and generates an inverse drawing force by flowing a strong inverse direction current in the coil.

BRIEF DESCRIPTION OF THE DRAWINGS

A more complete appreciation of the invention and any of the attendant advantages thereof will be readily obtained as the same becomes better understood by difference to the following detailed description when considered in connection with attached drawings, wherein.

DETAILED DESCRIPTION PREFERRED EMBODIMENT

A more detailed explanation will be given to an embodiment of the starter of an engine 10 according to this invention which is shown in the attached drawings.

Figure 1:
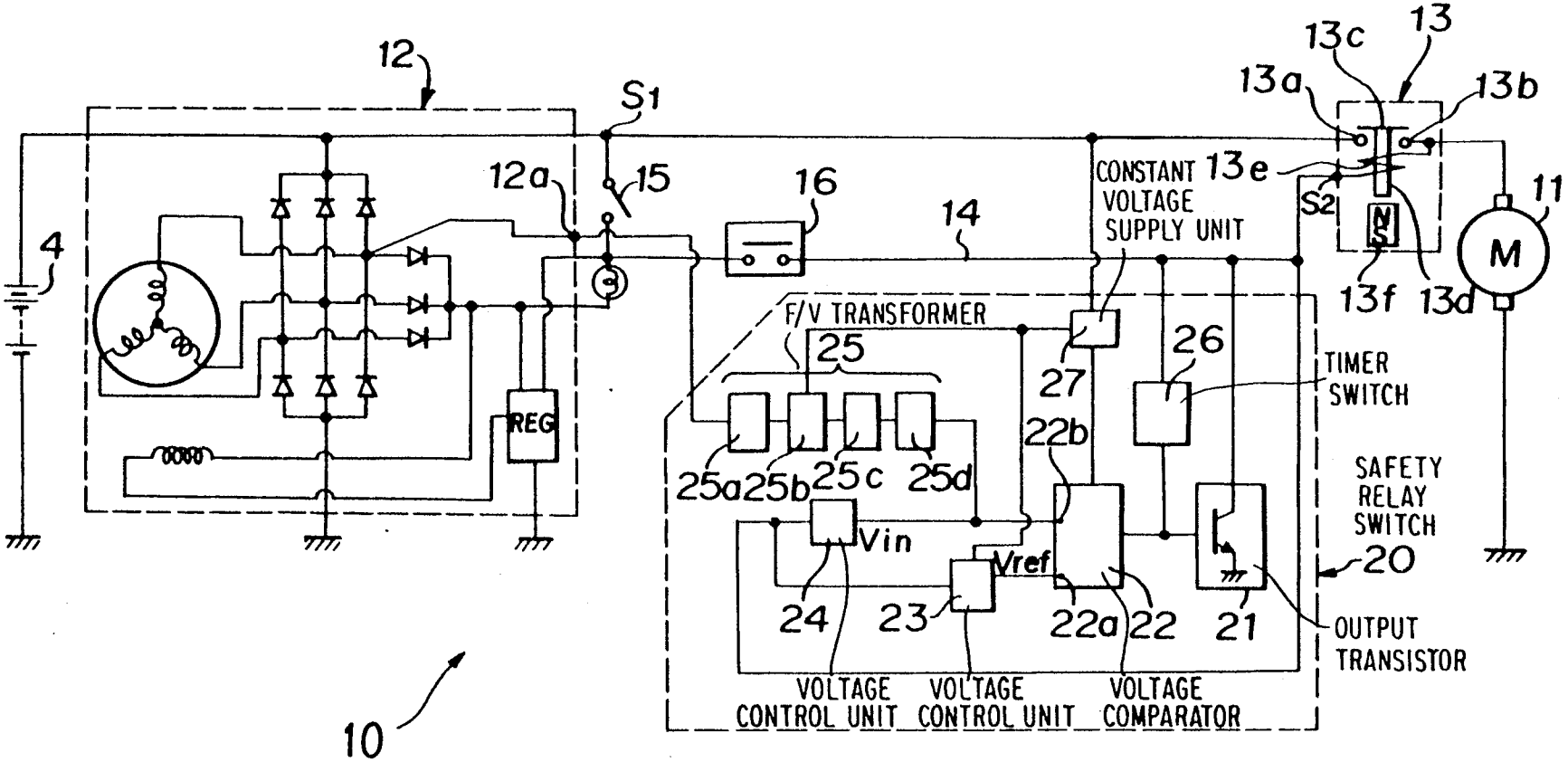
FIG. 1 is a circuit diagram showing an embodiment of a starter of an engine according to the present invention.

FIG. 1 shows an embodiment of the starter of an engine according to the present invention. The starter of an engine 10 in this embodiment, in a broad classification, composed of the starting motor 11 which applies a driving force for starting the engine, the detecting means 12 which generates a voltage which corresponds with a revolution of the engine, the electromagnetic switch 13 which closes or breaks a current from the power source 4 to the starting motor 11, the main switch 15 which is installed at the start-up circuit 14 for activating the electromagnetic switch 13 in starting up of the engine, and the touch switch 16 for starting up of the engine, and the safety relay switch 20 which automatically stops the operation of the starting motor 11 when the engine is started.

For the detecting means 12 which generates a voltage corresponding with the revolution of an engine, a charging generator or an alternator mounted on a vehicle is utilized, wherein the p-phase voltage is utilized. The alternator is already well known and the explanation of the structure is omitted. The alternator rotates in response with the rotation of an engine, and the voltage which is proportional to revolution number, is generated as the p-phase voltage.

The electromagnetic switch 13 is composed of two fixed contacts 13*a* and 13*b*, the moving contact 13*c* which shorts or opens the fixed contacts 13*a* and 13*b*, the plunger 13*d* which supports the moving contact 13*c*, the coil 13*e* which draws the plunger 13*d*, and the permanent magnet 13*f* which retains the drawn plunger 13*b*. The fixed contact 13*a* is connected to the plus terminal of a battery which is a power source, and the fixed contact 13*b* is connected to the starting motor 11.

The start up circuit 14 which activates the electromagnetic switch 13 when the engine is started, is composed of an end $S_1$ of the circuit which is connected to the plus terminal of the battery 4, another terminal $S_2$ of the circuit is connected to an end of the coil 13*e* and the electromagnetic switch 13, the main switch 15 is installed on the battery side, and the touch switch 16 is installed on the electromagnetic switch side. The contacts of the touch switch 16 are usually open, and are closed only when an operator touches it by hand. The other end of the coil 13*e* of the electromagnetic switch 13 is connected to the fixed contact 13*b*.

Figure 2:
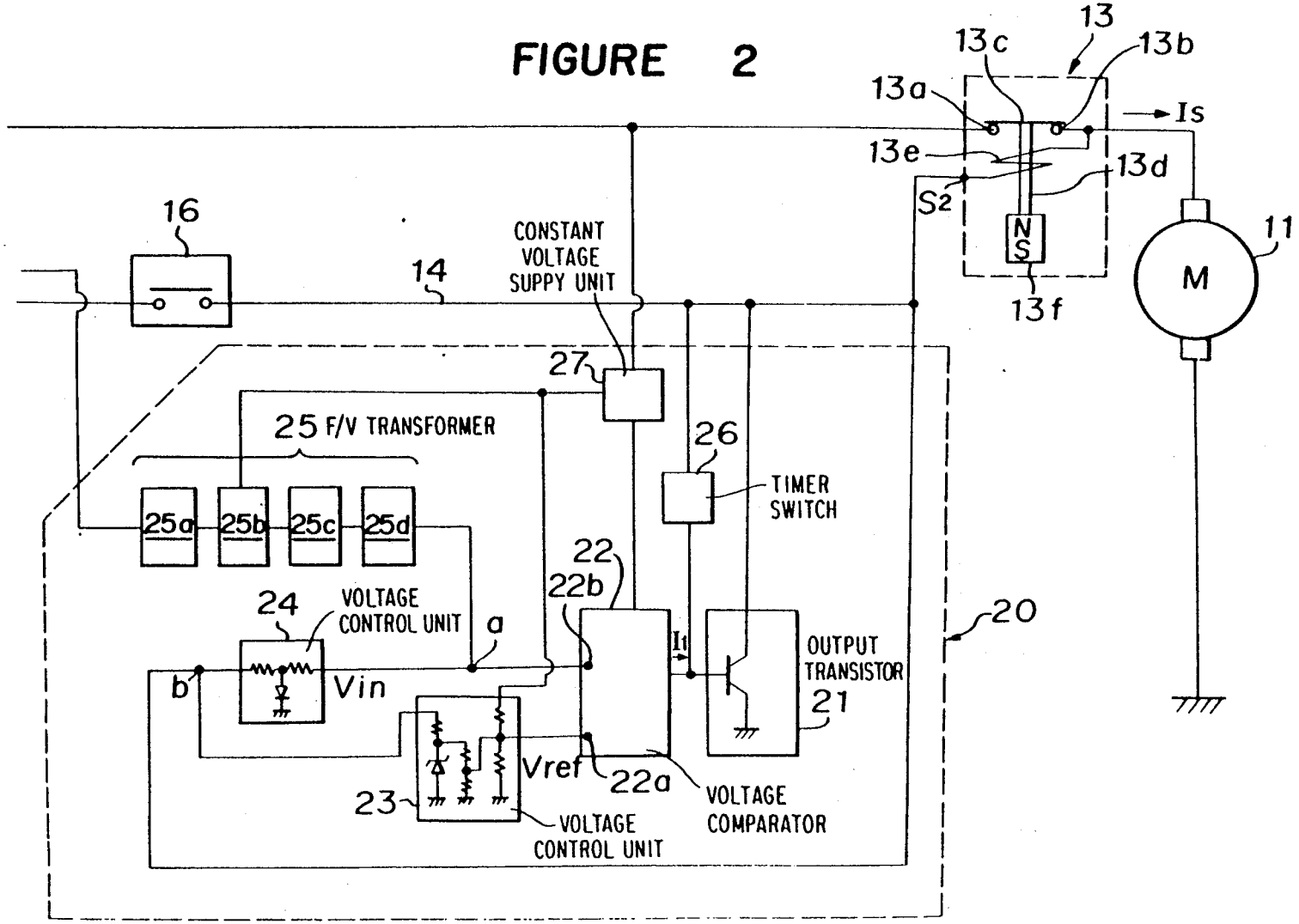
FIG. 2 is a partial circuit diagram showing an enlarged part of a safety relay device in the starter of an engine shown in FIG. 1.
Figure 3:
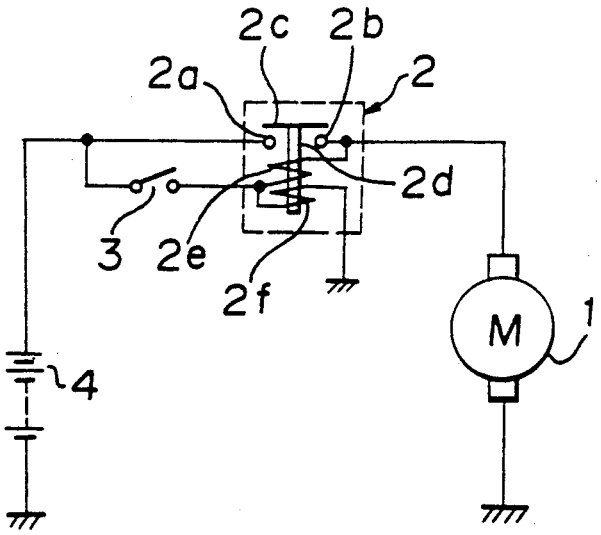
FIGURE 3 PRIOR ART
FIG. 3 is a circuit diagram showing a conventional general starter of an engine.

On the other hand, the safety relay device 20 is equipped with the output transistor 21 as a switch device for stopping the starting motor, as shown in the enlarged diagram of FIG. 2. The collector of the output transistor 21 is connected to the start-up circuit 14 which is situated between the touch switch 16 and an end of the coil 13*e*, and the emitter of the output transistor is connected to the earth. As for the voltage comparator 22 which generates an output current to the base of the output transistor 21, two input parts 22*a* and 22*b* are respectively connected to the reference voltage control unit 23 and to another end $S_2$ of the start-up circuit 14 via the input voltage control unit 24, that is, an end of the coil 13*e* of the electromagnetic switch 13.

The p-phase voltage output position 12*a* of the alternator 12 is connected to a circuit which connects the input unit 22*b* of the voltage comparator 22 and the input voltage control unit 24 via the F/V transformer (the frequency-voltage transformer 25 consisting of the input unit 25*a*, the shaping unit 25*b*, the differentiation circuit 25*c*, and the integration circuit 25*d*.

The other end $S_2$ of the start-up circuit 14 which is connected to an end of the coil 13*e* of the electromagnetic switch 13, is connected to the input side of the timer switch 26. The output side of the timer switch 26 is connected to the base of the output transistor 21. The timer switch 26 starts counting when the touch switch 16 is ON and the timer switch 26 receives a trigger signal. When the count reaches a predetermined number, that is, when a predetermined time (about 10 seconds) elapses after the touch switch 16 is ON, an inner switch is ON for a moment.

Furthermore, in the safety relay device 20, a numeral 27 signifies a constant voltage supply unit for operating the F/V transformer 25, the reference voltage control unit 23, and the voltage comparator 22.

Next, the operation of the embodiment of the starter of an engine 10 will be explained.

For instance when a driver gets in a car and tries to start an engine, first of all, he makes the main switch 15 turn ON. The main switch may be substituted by an electric system operating contact of a key switch of a vehicle. Next, the driver pushes the touch switch 16 for starting-up the engine. In this case the driver needs not keep pushing the touch switch 16 until the engine is started, and may stop pushing the switch so that the contact is opened, which is a characteristic of the present device 10. Instantly after the touch switch 16 is ON, current flows from the battery 4 to the coil 13*e* of the electromagnetic switch 13 via the starter circuit 14, the plunger 13*d* is drawn by a magnetic field generated by the coil 13*e* and the plunger 13*d* touches the permanent magnet 13*f* and is retained thereby. At this stage, the current flown in the start-up circuit 14 is broken by the OFF operation of the touch switch 16.

By the move of the plunger 13*d* the moving contact 13*c* shorts the fixed contacts 13*a* and 13*b*, by which current is flown from the battery 4 to the starting motor 11 which is driven for starting up of the engine. During the operation of the starting motor 11, or cranking of the engine, a current flows in the inverse direction, from the fixed contact 13*b* to the coil 13*e*, the current being outputted to the input unit 22*a* of of the voltage comparator 22 as $V_{ref}$, and to the input unit 22*b* of the voltage comparator 22 as $V_{in}$, respectively, via a reference voltage control unit 23 and the input voltage control unit 24. The voltage $V_{ref}$ is in the state of Zener voltage (about 1.2 V) since the fixed contacts 13*a* and 13*b* of the electromagnetic switch 13 are shorted, or ON. On the other hand, the voltage $V_{in}$ is a normal direction voltage of a diode (about 0.5 V). By the way, the inverse direction current which flows in the coil 13*e*, when the size of the series resistance of the reference voltage control unit 23 is set to a large value, becomes very small, and the power consumption is very small. Therefore, the inverse drawing force generated by that is too small to compete with the drawing force of the permanent magnet 13*f*. Accordingly, the moving contact 13*a* does not return to the original position, and the shortage of the fixed contacts 13 and 13*b* is maintained.

Before the engine is started or in cranking, the revolution number of the alternator 12 is naturally low, and the direct current voltage which is generated at the point "a" (FIG. 2) via the F/V transformer 25, is proportional to the revolution number of the alternator and is extremely low. Accordingly, $V_{ref} > V_{in}$. The voltage comparator 22 does not output a signal when each voltage of the input units 22*a* and 22*b* is in the relations of $V_{ref} > V_{in}$, and outputs a signal when $V_{in}$ is larger than $V_{ref}$, that is, $V_{ref} < V_{in}$.

When the engine is starting up, the number of revolution of the alternator 12 is increased, and the direct current voltage generated at the point "a" is elevated. When the revolution number of the engine reaches a predetermined number of revolution, $V_{ref} < V_{in}$, the voltage comparator 22 outputs the current $I_1$ to the base of the transistor 21. By this output, the output transistor 21 is in the state of ON wherein current can be flown from the collecter to the emitter, and a large current is flown from the fixed contact 13*b* of the electromagnetic switch 13 through the coil 13*e* and out transistor 21. As the result, by this large current in the inverse direction flown in the coil 13*e*, a large inverse drawing force is generated at the coil 13*e*, which surpasses the drawing force of the permanent magnet 13*f*, draws back the plunger 13*d*, and returns the moving contact 13*c* to the original position which cuts electricity to the starting motor 11. By this cutting, the operation of the starting motor 11 is stopped. Accordingly, when the engine is started up, the operation of the starting motor 11 is automatically stopped in spite of the handling of the driver.

Next, explanation will be given to the case in which a driver pushes the touch switch 16 erroneously when the engine is running. When the engine is running, the revolution number of the alternator 12 surpasses a predetermined number. Accordingly the relationship between $V_{ref}$ and $V_{in}$ in the safety relay device 20 is always $V_{ref}<V_{in}$, the output transistor 21 being always the state of ON by the output Of the voltage comparator 22. Accordingly, even if a driver erroneously pushes the touch switch 16; the current flown in start-up circuit 14 flows though the output transistor 21, and almost no current is flown in the coil 13*e* and the electromagnetic switch 13 is not activated.

When the engine itself is not in a normal condition, and when the engine is difficult to be started up in winter, as shown in the above explanation, current is kept flowing and starting motor 11 until the engine is started up. This running condition should be avoided to prevent the malfunction of the battery 4 and the burning of the starting motor 11. Therefore, at the moment when the touch switch 16 is ON, the timer switch 26 is initiated by a trigger signal. After a predetermined time (about 10 seconds), the timer switch 26 is ON and generates the current $I_1$ which makes the output transistor 21 ON, and the starting motor 11 is stopped.

As stated above, when engine is difficult to be started up, or when the engine is not started up after a predetermined time, the flow of current to the starting motor 11 is broken. Explanation will be given to the case when the touch switch 16 is pushed, and when the starting motor 11 is not completely started and is running with inertia. When the starting motor 11 is running with inertia, the generated voltage is applied on point "b". The applied voltage is extremely low compared with the voltage of the power supply. The reference voltage, $V_{ref}$ returns to the voltage for when the starting motor is not running (which is stabilized to a constant value, about 0.1 V, by the constant voltage power source unit 27). On the contrary by the running with inertia of the starting motor 11, the input voltage $V_{in}$ is higher than the reference voltage $V_{ref}$ which is about 0.5 V. Therefore $V_{ref}<V_{in}$, and the power transistor 21 is ON. The electromagnetic Switch 13 is not activated and no current is flown to the starting motor 11. Accordingly, it is prevented that the starting motor 11 is restarted when it is running with inertia, and a pinion of the starting motor 11 is collided with a ring gear, which causes destruction of the gear and so on, or generates a noise.

In the above mentioned embodiment of the starter for an engine 10, the permanent magnet 13*f* is utilized for retaining the drawn position of the plunger 13*b* of the electromagnetic switch 13. However in this invention the permanent magnet can be substituted by a solenoid. The output transistor 21 is utilized as a switch device for the stopping of the starting motor. However the output transistor can be replaced by the other relay means. Furthermore, the starting up of the engine is detected by the p-phase voltage at the alternator 12. However the starting up can be detected by the n-phase voltage or by the ripple voltage of the power supply system.

As explained above, according to the starter of an engine of the present invention, when a driver starts an engine, the starting motor for starting up of the engine is started by the driver by pushing a touch switch for the starting up of the engine for a moment. After the engine is started up, the starting motor stops in spite of the handling of the driver. Therefore a beginner or a person who is not accustomed to the operation, can start up the engine with certainty, and without a damage to machine or a noise.

What is claimed is:

1. A starter of an engine which comprises:

a starting motor which applies a driving force for starting an engine;

detecting means for generating a first voltage signal corresponding to a number of revolutions of the engine;

an electromagnet switch having a moving contact supported by a plunger which opens and closes two fixed contacts that are respectively connected to a power source and the starting motor, a coil having one end connected to a point between the starting motor and one of the fixed contacts for drawing said plunger so that the fixed contacts are shorted by the moving contact, and a magnet for retaining the plunger in a drawn position;

a main switch and a normally open touch switch for starting the engine installed in a start-up circuit by connecting said power source to a second end of the coil of the electromagnetic switch so that current is supplied to the coil of the electromagnetic switch for activating the starter motor in starting the engine;

a voltage comparator for comparing a second voltage signal produced by a weak inverse direction current flowing in the coil of the electromagnetic switch when the fixed contact are closed with the first voltage signal generated by said detecting means and for outputting a current when the first voltage signal is greater than said second voltage signal; and a switch device responsive to said current outputted by said voltage comparator for stopping the starting motor when in a conductive state by electrically connecting said second end of said coil to ground so that a strong inverse direction current flows through said coil generating an inverse drawing force.

2. The starter of an engine according to claim 1, said detecting means further comprising:

a frequency-voltage transformer responsive to an output of an alternator for generating said first voltage signal comprising:

an input unit receiving said output of said alternator;

a shaping unit for shaping an output of said input unit;

a differentiation circuit responsive to an output of said shaping unit; and an integration circuit responsive to an output of said differentiation circuit and outputting said first voltage signal.

3. The starter of an engine according to claim 1, further comprising a means for preventing activation of said electromagnetic switch upon erroneous operation of said touch switch.

4. The starter of an engine according to claim 1, further comprising a timer means responsive to a trigger signal generated by said touch switch for stopping said starter motor after a predetermined period of time.

* * * * *